US005513700A

United States Patent [19]

Kleve et al.

[11] Patent Number: 5,513,700

[45] Date of Patent: May 7, 1996

[54] AUTOMOTIVE EVAPORATOR MANIFOLD

[75] Inventors: Allan J. Kleve; Jay D. Siegler, both of Canton; Thomas J. Nieman, Livonia; Stephen A. Hoynacki, Canton, all of Mich.

[73] Assignee: Ford Motor Company, Dearborn, Mich.

[21] Appl. No.: 282,244

[22] Filed: Jul. 29, 1994

[51] Int. Cl.[6] ..... F28D 1/06

[52] U.S. Cl. ..... 165/153; 165/167; 165/178

[58] Field of Search ..... 165/153, 167, 165/178

[56] References Cited

U.S. PATENT DOCUMENTS

| | | | |
|---|---|---|---|
| 3,537,165 | 11/1970 | Paddock et al. | 165/166 X |
| 3,976,128 | 8/1976 | Patel et al. | 165/153 |
| 4,274,482 | 6/1981 | Sonoda | 165/153 |
| 4,614,231 | 9/1986 | Proctor et al. | 165/153 |
| 4,945,981 | 8/1990 | Joshi | 165/166 X |
| 5,151,157 | 9/1992 | Le Gauyer | 165/76 X |
| 5,176,205 | 1/1993 | Anthony | 165/153 X |
| 5,346,003 | 9/1994 | Halstead et al. | 165/173 |

FOREIGN PATENT DOCUMENTS

| | | | |
|---|---|---|---|
| 3215961 | 11/1983 | Germany | 165/173 |
| 3500571 | 11/1985 | Germany | 165/153 |
| 147288 | 6/1989 | Japan | 165/167 |

*Primary Examiner*—Leonard R. Leo

*Attorney, Agent, or Firm*—Raymond L. Coppiellie; Roger L. May

[57] ABSTRACT

A plate-fin heat exchanger 10 is disclosed including a plurality of flat tubes 14 interleaved with a plurality of fin members 16. The flat tubes 14 are formed from a plurality of plate members 12. The heat exchanger 10 also includes a plurality of fin members 16 and a pair of fluid manifolds 22, 24. The manifolds 22, 24 are formed as one-piece members having a flange formed between the ends. The flange is brazed directly to the endsheet of the evaporator.

8 Claims, 2 Drawing Sheets

AUTOMOTIVE EVAPORATOR MANIFOLD

BACKGROUND OF THE INVENTION

1. Field of the Invention

The present invention relates generally to a heat exchanger for an automotive vehicle. More particularly, the present invention relates to a manifold for use in a plate-fin type evaporator for an automotive vehicle.

2. Disclosure Information

Plate-fin heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates so as to form a flat tube. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles.

Typically, plate-fin heat exchangers are manufactured by stacking a plurality of individual plates together to form a flat tube and interleaving fin members between each tube. Endsheets are then placed on opposite ends of the heat exchanger to form a heat exchanger core. An inlet and outlet manifold are then inserted into an aperture formed in the endsheet to provide for fluid communication into and out of the evaporator. The core is brazed in a furnace to complete the manufacturing process.

Various types of manifold designs have been proposed for use in a plate-fin type heat exchanger. For example, U.S. Pat. No. 3,976,128 discloses a manifold passing through a reinforcing plate which has been brazed to the endsheet of the evaporator. The reinforcing plate and the manifold ate two separate pieces requiring additional brazing therebetween, possibly resulting in leakage if a good braze joint is not formed. U.S. Pat. No. 4,614,231 discloses a manifold having a flange formed in one end. The flange engages a female coupling member which has been brazed to a reinforcing plate brazed to the endsheet. A male coupling member releasably connects the manifold to the evaporator. The flange provides a seat for an O-ring to provide better sealing of the male and female couplings. The flange is not brazed directly to the endsheet since this would eliminate the releasability of the connection as disclosed in the patent. It would be advantageous to provide a manifold for a heat exchanger which reduces the number of components to be brazed and thus eliminates the need for an additional brazing to be performed on the evaporator and which provides improved rigidity thereto.

SUMMARY OF THE INVENTION

The present invention overcomes the above problems with the prior art by providing a manifold for use in an automotive heat exchanger having a core including a plurality of tubes interleaved with fin members, and a pair of endsheets disposed on opposite ends of the core, each of the endsheets having an aperture therein. The manifold comprises a unitary member having a first end and a second end being fluidly connected to the heat exchanger core. A generally planar flange is interposed between the first and second ends, said flange being adapted to be brazed directly to one of said endsheets. In the preferred embodiment, the manifold is formed as a unitary piece from an extrusion process out of an aluminum alloy.

It is an advantage of the present invention to provide a manifold for a heat exchanger for an automotive vehicle wherein the manifold provides added structural rigidity to the heat exchanger. These and other objects, features and advantages of the present invention will become apparent from the drawings, detailed description and claims which follow.

DETAILED DESCRIPTION OF THE PREFERRED EMBODIMENTS

Figure 1:
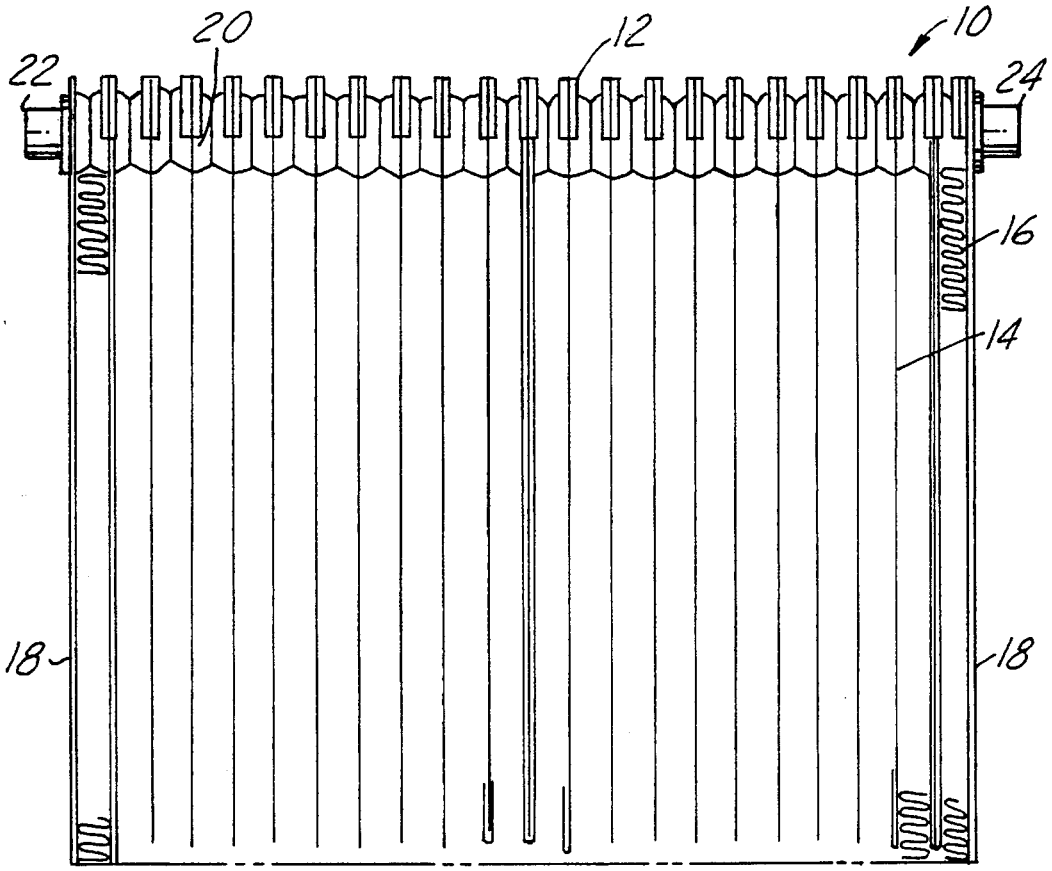
FIG. 1 is a perspective view of a heat exchanger structured in accord with the principles of the present invention.

Referring now to the drawings, FIG. 1 shows a plate-fin heat exchanger, generally designated by the numeral 10, in the form of an evaporator particularly adapted for use in an automobile air conditioning system. As is well know in the art, evaporator 10 comprises a stack of formed, elongated plates 12, pairs of which are joined together in abutting face-to-face relationship so that adjacent pairs form flat fluid tubes 14 which provide alternate passageways for the flow of a refrigerant fluid therebetween. The plates may be joined in any of a variety of known processes, such as through brazing or a lamination process. Heat transfer fins 16 are positioned between flat tubes 14 to provide increased heat transfer area as is well known in the art. The flat tubes and fin assemblies are contained within generally planar endsheets 18. Such an evaporator is well described in U.S. Pat. No. 5,125,453, assigned to the assignee of the present invention, the disclosure of which is hereby incorporated by reference. The present invention is also well suited for other types of heat exchangers known in the automotive art.

The evaporator 10 further includes an inlet manifold 22 and an outlet manifold 24 in fluid communication with the evaporator tank 20 at one end of the evaporator 10. The tank 20 is in direct communication with the passageways of the tubes 14 and as is known, the tubes have aligned apertures at one end thereof providing communication between the inlet and outlet manifolds 22, 24 respectively of tank 20. In the heat exchanger of FIG. 1, refrigerant is directed into inlet manifold 22 and passes through the plurality of flat tubes 14 in a known manner. The refrigerant then exits through the outlet manifold 24 to complete the cooling cycle. The manifolds 22, 24 can be located at any corner of the evaporator.

The manufacture of the plate-fin evaporator 10 is accomplished in a manner well known in the art. The plurality of formed elongated plates are generally formed from an aluminum material coated with an aluminum brazing alloy. The various components forming the entire unit are made from aluminum stock, then assembled as shown in FIGS. 1 and 2, and passed through a vacuum brazing operation in which the metal brazes together to form an integrated unit.

Alternatively, other known processes may be used in the manufacture of the evaporator 10. The fabrication of the evaporator is not meant to be limited to a specific manufacturing process.

Figure 2:
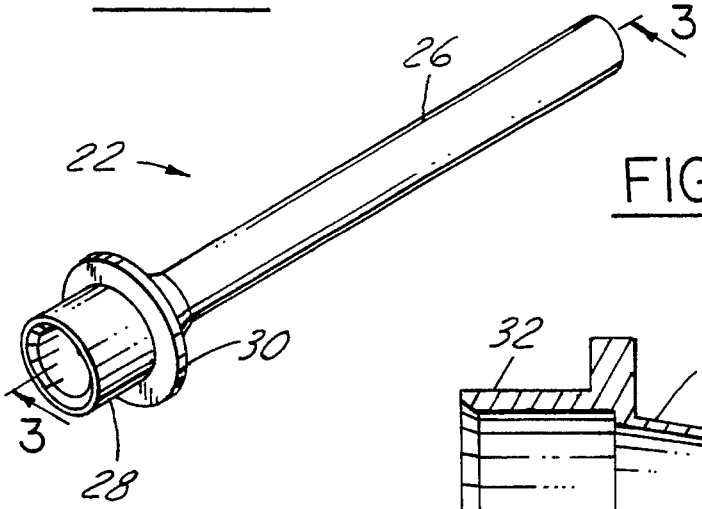
FIG. 2 is a perspective view of a manifold structured in accord with the principles of the present invention.
Figure 3:
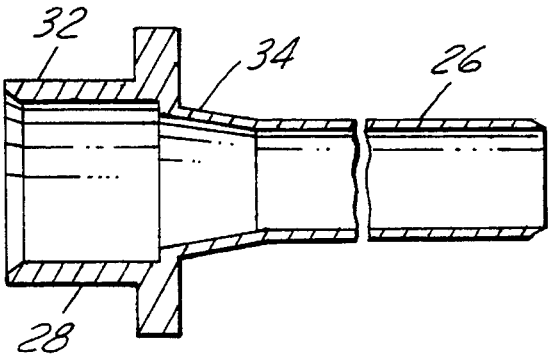
FIG. 3 is a cross-sectional view taken along line 3—3 of FIG. 2.
Figure 4A:
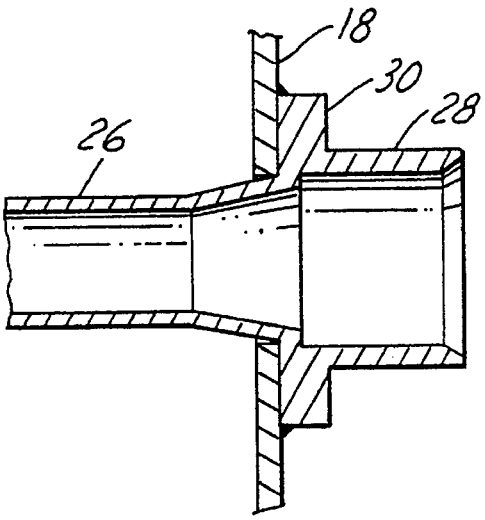
FIGS. 4A and B are enlarged cross-sectional views of two embodiments of a manifold of the present invention projecting into an evaporator of the present invention.
Figure 4B:
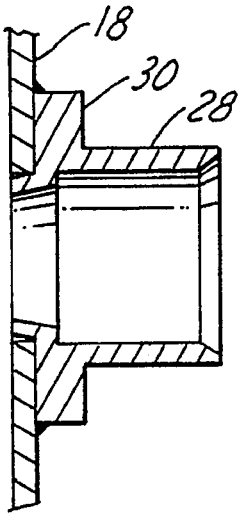

Referring now to FIGS. 2–4, the manifold 22 will be described in detail. Each of the manifolds 22, 24 is formed as a unitary member during an extrusion process. The manifolds can be formed from any alloy but preferably from an aluminum alloy. By forming the manifolds as a unitary member, the manifold will not leak due to insufficient brazing of a plurality of pieces such as has been done prior to the present invention. The manifold 22 includes a generally tubular member having a first end 26 which carries refrigerant into or out the evaporator 10. The manifold further includes a second end 28 fluidly communicating with the evaporator 10 and a generally planar flange 30 interposed between the first 26 and second 28 ends. The first end 26 projects through an aperture in an endsheet and into the evaporator tank. The first end may be pierced with holes to allow fluid to enter or exit therefrom. In the embodiment shown in FIG. 4B, the first end is very short and is essentially planar with the interior surface of the endsheet. This allows for a greater volume of fluid to flow into or out the evaporator.

The second end 28 of the tubular member includes a generally cylindrical wall 32 extending generally perpendicular to the plane of the flange 30 by a predetermined distance. The wall 32 projects outwardly from the endsheet 18 a predetermined distance and is connected to a fluid conduit. The wall 32 is generally circular but may also be D-shaped to fit into a keyed fluid conduit. This would allow for proper location of the manifold should the manifold be required to be bent in a non-linear shape due to packaging requirements.

The flange 30 is formed as part of the unitary tubular member and has a diameter greater than the diameter of the second end 28. The flange 30 is vacuum brazed to the exterior surface of the endsheet. The flange increases the rigidity of the evaporator for improved pressure cycle performance. This is due to the increase braze area provided by the flange and also as a result of less transverse flexing by the manifold due to the larger base area.

As can be seen in the drawings, the tubular member may include a first 26 and second 28 ends having different diameters. In such case, the first end gradually tapers as at 34 from a predetermined diameter to a greater diameter at the flange 30.

Figure 5A:
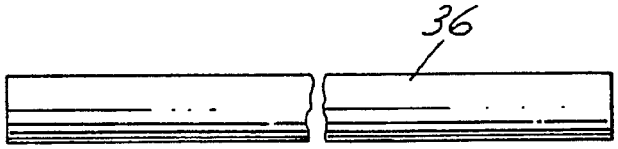
FIGS. 5A–D are schematic views of the manufacturing steps employed in fabricating a manifold according to the present invention.
Figure 5B:
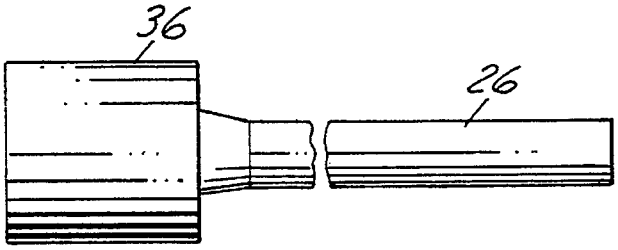
Figure 5C:
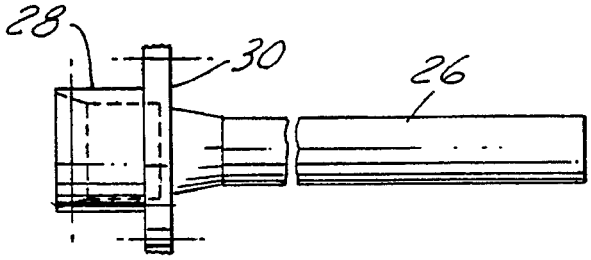
Figure 5D:
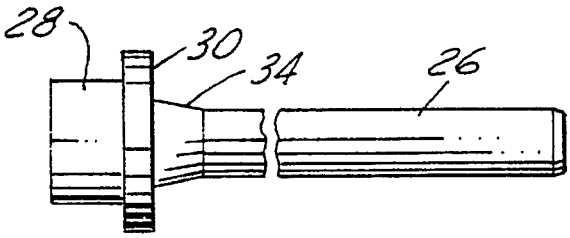

FIGS. 5A–D show the manufacturing steps necessary to fabricate a manifold according to the present invention. As shown in FIG. 5A, a blank 36 of aluminum is first formed and an aperture may be formed at this time. The blank is then impact extruded in a one stroke die with two stages of extrusion as shown in FIGS. 5B and C. FIG. 5B shows the extrusion of the first end 26 of the manifold and FIG. 5C shows the final stage of fabrication wherein the second end 28 and flange 30 are also impact extruded. After extrusion, the first and second ends are cut to predetermined lengths and flash is trimmed from the manifold such as is shown in FIG. 5D.

Various modifications and alterations of the present invention will, no doubt, occur to those skilled in the art, to which this invention pertains. These and all other variations which rely upon the teachings by which this disclosure has advanced the art are properly considered within the scope of this invention as defined by the appended claims.

What is claimed is:

1. A manifold for use in an automotive heat exchanger having a core including a plurality of tubes interleaved with fin members, and a pair of endsheets disposed on opposite ends of the core, each of the endsheets having an aperture therein, said manifold consisting of:

a one piece member having a first end with a first predetermined diameter and configured to project through the aperture in one of the endsheets a predetermined distance into the core, a second end having a second predetermined diameter and being fluidly connected to said core, and a generally planar flange interposed between said first and second ends, said flange being configured to be brazed to one of said endsheets and having a diameter greater than the diameters of the first and second ends of the one piece member, the second end further including a generally cylindrical wall extending generally perpendicularly to the plane of the flange, and wherein the first end diameter of said one piece member is less than the second end diameter of said one piece member and tapers from said first predetermined diameter to a greater diameter at said flange.

2. A manifold according to claim 1, wherein said flange is configured to be vacuum brazed to said endsheet.

3. A manifold according to claim 1, wherein said manifold is manufactured from an aluminum alloy.

4. A manifold according to claim 3, wherein said manifold is fabricated by an impact extrusion process.

5. A heat exchanger for an automotive vehicle, comprising:

a core including a plurality of tubes interleaved with a plurality of fins;

a pair of endsheets disposed on opposite sides of the core, each of the endsheets having an aperture therein;

a pair of fluid manifolds for the inlet and outlet of heat exchange fluid to and from said heat exchanger, each of said manifolds consisting of a one piece member having a first end with a first predetermined diameter configured to project through an aperture in one of said endsheets a predetermined distance into said heat exchanger core, a second end having a second predetermined diameter and being fluidly connected to said core, and a generally planar flange interposed between said first and second ends, said flange being brazed to one of said endsheets, having a diameter greater than the diameters of the first and second ends of the one piece member, the second end further including a generally cylindrical wall extending generally perpendicularly to the plane of the flange, and wherein the first end diameter of said one piece member is less than the second end diameter of said one piece member and tapers from said first predetermined diameter to a greater diameter at said flange, and wherein said core and said pair of manifolds are brazed together to form an integral body.

6. A heat exchanger according to claim 5, wherein said manifolds are manufactured from an aluminum alloy.

7. A heat exchanger according to claim 6, wherein said manifolds are fabricated by an impact extrusion process.

8. A heat exchanger according to claim 7, wherein said heat exchanger is an evaporator.

* * * * *